United States Patent [19]

von der Eltz

[11] 4,240,790

[45] Dec. 23, 1980

[54] PROCESS FOR DYEING AND PRINTING FLAT TEXTILE MATERIAL CONTAINING SYNTHETIC FIBERS

[75] Inventor: Hans-Ulrich von der Eltz, Willibrachtstrasse 14, D 6000 Frankfurt am Main 50, Fed. Rep. of Germany

[73] Assignee: Hans-Ulrich von der Eltz, Frankfurt am Main, Fed. Rep. of Germany

[21] Appl. No.: 971,225

[22] Filed: Dec. 20, 1978

[30] Foreign Application Priority Data

Dec. 22, 1977 [DE] Fed. Rep. of Germany ..... 2757259

[51] Int. Cl.[3] ..... D06P 3/82

[52] U.S. Cl. ..... 8/529; 8/149.1

[58] Field of Search ..... 8/149.1, 21 A, 21 B, 8/21 C, 1 A

[56] References Cited

U.S. PATENT DOCUMENTS

| | | | |
|---|---|---|---|
| 4,041,559 | 8/1977 | von der Eltz | 8/149.1 |
| 4,064,583 | 12/1977 | von der Eltz | 8/149.1 |
| 4,077,766 | 3/1978 | von der Eltz | 8/44 |
| 4,082,504 | 4/1978 | von der Eltz | 8/44 |

*Primary Examiner*—Lewis T. Jacobs

*Attorney, Agent, or Firm*—Connolly and Hutz

[57] ABSTRACT

A process for dyeing and printing flat textile articles consisting of or containing synthetic fibers, by pretreating the goods in rope form, with at least one pretreatment bath having a temperature of from 80° to 140° C., removing water from the goods or drying them, impregnating the goods at full width, fixing the dyestuffs and aftertreating the goods anew in rope form, under as little tension as possible, in at least two baths, optionally in the presence of surfactants, at least one bath having a temperature of from 80° to 140° C., and advancing the goods in a dwelling chamber by means of a winch or by nozzles in a way to make sure that folds in the rope change their position or that the rope is opened.

This process endows an optimum handle and final aspect to the fabric.

9 Claims, No Drawings

PROCESS FOR DYEING AND PRINTING FLAT TEXTILE MATERIAL CONTAINING SYNTHETIC FIBERS

The present invention relates to a process for dyeing and printing flat textile articles containing synthetic fibers.

Processes for dyeing and printing flat textile articles, such as fabrics, knit fabrics, fleeces, non wovens and the like, which consist of or contain synthetic fibers, are well known. Thus, dyeing processes for polyester fibers and for blends thereof are known, using disperse dyes, in which the padded or printed textile material, after drying, is submitted to a hot air or hot steam treatment, at a temperature of from about 170° to 230° C., to the so-called thermosol treatment, and subsequently aftertreated in usual manner. Suitable dyes for fiber blends with cellulose fibers, in addition to disperse dyes, include all those classes of dyes which are appropriate for cellulose fibers, whereas fiber blends with wool are suitably dyed with acid dyes, reactive dyes or metallic complex dyes, in addition to disperse dyes. A variety of possibilities exist, in which the dyes are employed in a one-bath or in a multiple-bath process (cf. German Patent Specifications Nos. 16 10 951; 17 69 647; 19 09 518; German Auslegeschrift No. 17 69 091).

Furthermore processes are known for dyeing and printing polyamide or polyacrylonitrile fibers with acid dyes, reactive dyes or metallic complex dyes or with cationic dyes, in which the dyes are fixed by steaming.

All of these dyeing processes have been described in detail in the literature. They have in common that the application of the dyes, drying, thermosoling or steaming are carried out with the goods being at full width. In order to reach a continuous mode of finishing the pre- and the aftertreatment of the goods, too, were carried out with the goods being in open width.

For the pretreatment, the textile material at full width is submitted, for example to singeing, desizing, washing, mercerization and drying. The order of the individual steps depends on the nature of the articles and of the accompanying fibers and varies considerably. For aftertreatment purposes, the textile material is guided at full width through the corresponding treatment baths.

During the pretreatment and during the aftertreatment, a relatively high longitudinal stress acts on the textile material, which is conditioned by the manner of guiding the goods, for example by passing them over rollers, and by the tensile stress which is unavoidable in this process. This cloth tension prevents that the dyed or printed textile material takes a too soft handle and that this handle gets a wool-like character, especially in the case of blends with cellulose fibers. This influence is particularly defavorable for thermosoled textile material.

Trials have moreover been made to surmount these disadvantages by carrying out thermosoling, steaming or washing under as little tension as possible, using perforated drums, a festoon system or screen belt agers. However, only gradual improvements were obtained in these processes and the results hitherto reached could not equal those obtained in jet dyeing.

A process has now been found which makes it possible to obtain dyed or printed flat textile material consisting of or containing synthetic fibers with considerably improved handle.

The present invention, consequently, provides a process for dyeing and printing flat textile articles consisting of or containing synthetic fibers endowing an optimum handle to the goods, in which process the textile material is pretreated, subsequently impregnated with dyes in aqueous solution or in dispersion, optionally intermediary dried, thermosoled or steamed in order to fix the dyes and submitted to an aftertreatment with hot water, in the presence of auxiliaries, which comprises pretreating the goods in rope form, with at least one pretreatment bath having a temperature of from 80° to 140° C., preferably of from 95° to 120° C., removing water from the goods or drying them, impregnating them with dyestuffs, fixing the dyestuffs and anew treating the goods in rope form, under as little tension as possible, in at least two baths, optionally in the presence of surfactants, at least one bath having a temperature of from 80° to 140° C., preferably from 95° to 120° C., and advancing the goods in a dwelling chamber by means of a winch or by nozzles in a way to make sure that folds in the rope change their position or that the rope is opened. The present invention also contemplates pretreating the textile ropes which have been spread to the full width provided the pretreatment is performed under as little tension as possible.

The process according to the invention is particularly appropriate for dyeing or printing textile material which contains, in addition to synthetic fibers, other fibers, for example, polyester fiber-rayon staple fiber blended spun or woven fabrics. For this purpose, any of the usual dyeing methods operating with a single bath or with multiple baths, have proved appropriate.

A substantial feature of the present invention is the pretreatment and/or the aftertreatment of the goods under little tension, for example in a dwelling chamber. In this chamber, the textile material is exposed to no tensile stress neither across its width nor in its longitudinal direction. By the term "little tension" there is to be understood that the textile material is practically swimming in the bath or is being advanced in tensionless state resting on a conveying element. It was surprising that the textile material, although present in rope form, was excellently penetrated by the treatment baths and furthermore, the moving speed of the goods and the treatment effect were highly astonishing. Especially the pretreatment at a temperature of from 80° to 140° C., preferably of from 95° 120° C., in tensionless state permits a shrinkage of the goods to such a degree that in subsequent continuous guidance at open width they can no longer be spread in a way such that they get a flat appearance. A stiffness which may occur in some cases during the thermosol process, may be removed by the aftertreatment according to the invention in the dwelling chamber.

The pretreatment in rope form is a commonly known practice, for example for bleaching and washing. The aftertreatment of printed or dyed textile material in rope form is likewise known. It may be carried out, for example, on winches or in rope washing machines, in which the textile material is passed through several baths.

In practice there is generally the fear that creases might be formed by treating the fabrics in rope form, especially with unfixed synthetic fibers, when treatment processes in rope form are combined with dyeing or printing processes at full width.

This prejudice was particularly pronounced with regard to processes working at a temperature of more than 100° C. Consequently, it was surprising and not to be expected at all that just a pretreatment at a temperature of from 100° to 140° C. influences the final results particularly advantageously with regard to the handle of the goods.

It has long been believed impossible to lead a compressed textile rope, which, consequently, has a varying density, into a pressure chamber by passing it over a sealing element. A device according to German Offenlegungsschrift No. 25 37 665, however, makes it possible to introduce even rope material into a steamer, if necessary, by passing it through several pressure seals. This sealing device has also proved appropriate for continuously leading wet textile material in the form of endless ropes into or out of pressure-tight vessels containing aqueous liquors, under HT conditions.

Alternatively, the textile material may be introduced at full width into a pressure chamber by passing it over any of the known roller seals or over a lip seal, which is known in practice. It this case, it is only in the pressure chamber, where the goods are treated in rope form.

This treatment has the advantage that in the so-called HT chamber, no tension can act on the textile material. Thus, shrinkage of the textile material can be controlled by the treatment temperature, by the nature or the quantity of the additives to be possibly used. The frequently prevailing opinion, according to which the HT treatment in rope form has a particular detrimental influence on the uniformity of a continuous dyeing, could not be confirmed, since in a continuous run in rope form, the goods are repeatedly opened or the positions of the folds are changed.

The rope may be opened by nozzles, for example by sheet nozzles, such as oval nozzles, in which case the jet of liquor directed against the textile material may serve simultaneously for advancing it. Frequently it suffices to deviate the rope over rollers, especially when it may leave sidewards.

A particularly important factor in the aftertreatment, especially of printed material, is that the unfixed dyestuff does not bleed into the unprinted positions. Furthermore, particular attention should be paid to the washability of the thickening agents, which generally requires prolonged treating times in the washing unit. Dwelling chambers for rope material are not suited for this purpose in all cases. To avoid these inconveniences, the aftertreatment of printed material according to the invention is started under almost tensionless conditions with the goods being at full width, for example in a festoon system and only after a predetermined treating time, the goods are passed in rope form through the aftertreatment baths, of which at least one should have a temperature of from 80° to 140° C., preferably of from 95° to 120° C. and the textile material is advanced in a way such that a displacement or an opening of the rope and good liquor circulation, for example by means of circulation pumps, is made sure.

The process according to the invention has considerably economic advantages, because it permits a continuous long duration treatment of goods in rope form by simpler means than hitherto. On the other hand, it is a common practice to spread goods in rope form, while they are running forwards at high speed. To do this, so-called rope openers or expanders are used. The rope material may be spread, for example, by opening rollers, which are commonly known to an expert. Upon spreading, squeezing and suction devices may be employed as well as sandwiching in order to achieve an optimum hydroextraction, before drying is started. A perforated drum system or the drying method disclosed in German patent specifications Nos. 22 14 713 and 22 14 714 have proved advantageous for a particularly mild drying.

The process according to the invention is appropriate for dyeing and printing not only textile material which exclusively consists of synthetic fibers, such as, for example, polyester or polyamide fibers, or acrylonitrile fibers, but also for those which contain additionally cellulose fibers or wool. Suitable dyes, in addition to disperse dyes, are vat dyes, reactive dyes and sulfur dyes or acid and metallic complex dyes.

Appropriate fibers are meant to include staple fibers, threads, strands and possibly further structures which are suitable for manufacturing flat textile articles.

The polyester fibers for the dyeing and printing process according to the invention may consist of polyethylene terephthalate, polycyclohexandimethylene terephthalate, of heterogenic polyesters or terephthalic acid, isophthalic acid and ethylene glycol, of sulfoisophthalic acid and ethylene glycol, of copolyether-esters of p-hydroxybenzoic acid, terephthalic acid and ethylene glycol and polycarbonates, in which cases ethylene glycol may be partially replaced by propylene or butylene glycol.

Appropriate polyamide fibers include a variety of polamides, for example nylon 6, nylon 6,6 and others, whereas suitable polyacrylonitrile fibers may consist of acrylic or modacrylic fibers.

Examples of suitable cellulose fibers are the natural fibers, such as cotton, linen, flax or regenerated cellulose fibers, for example rayon staple fibers, modal fibers or rayon.

The following dyes have been used:

- as disperse dyes those designated in Colour Index, 3rd edition (1971)
- as disperse dyes,
- as cationic dyes, those designated in Colour Index 3rd edition (1971)
- as basic dyes,
- as reactive dyes those designated in Colour Index 3rd edition (1971)
- as reactive dyes,
- as vat dyes those designated in Colour Index 3rd edition (1971) as vat dyes
- as sulfur dyes those designated in Colour Index 3rd edition (1971) as sulphur dyes
- as acid dyes those designated in Colour Index 3rd edition (1971) as acid dyes and
- as metallic complex dyes those designated in Colour Index 3rd edition (1971) as acid dyes.

As thickening agents the commonly used products may be employed, for example, low viscous alginate thickeners, locust bean flower thickeners, or a petrol emulsion.

For the pretreatment and for the aftertreatment, anionic or nonionic compounds are generally used. In very rare cases, for example in the aftertreatment of direct dyestuffs or for softening purposes, cationic compounds may also be used.

As anionic substances which are added to the pretreatment or to the aftertreatment baths, alkylsulfates, sulfonated oils, alkylsulfonates, alkylarylsulfonates, alkylnaphthalene sulfate or Turkey-red oils may be mentioned.

Suitable nonionic compounds are addition products of ethylene, propylene or butylene oxide or mixtures thereof to fatty acids, fatty alcohols, fatty amines, fatty acid amides, alkylphenols, glycols and other compounds.

For the pretreatment there is used at least one bath of a temperature of from 80° to 140° C., in particular of from 95° to 120° C. Advantageously there is used first a bath of a temperature of from 80° to 90° C. and subsequently a bath of a temperature above 100° C., preferably of from 110° to 140° C. The number of the baths depends on the temperature, on the nature of the textile material or on the treating time of the textile material in the bath and is generally from 2 to 4.

For the aftertreatment, at least one bath of a temperature of from 80° to 140° C., preferably of from 95° to 120° C., is used, printed material being first washed at full width at low temperature and subsequently treated in rope form, as it has been mentioned hereinbefore. However, in horizontal dwelling chambers, in which the pressure of the superposed goods is not too high, even printed material may be aftertreated in rope form, directly after completion of the printing process.

The textile material may be sprayed by means of a ring nozzle and be subsequently squeezed or sucked off, at the intervals between the passages through the individual baths during the pretreatment and during the aftertreatment.

For a treatment under little tension conditions, a dwelling chamber for rope material is especially appropriate, in which a circulation pump ensures a particularly good liquor flow. In this process, the liquor is sucked off at predetermined positions and recycled to the same bath by means of a pump and passing it over heat exchangers and nozzles to the following bath. The dwelling chamber may be horizontal, vertical or U-shaped. A slight inclination of horizontal dwelling chambers has proved particularly advantageous in the case of textile material which is sensitive to pressure. For better sliding properties of the textile material in the dwelling chamber, plastics-lined stainless-steel sheets are particularly preferred. The dwelling chambers may also be equipped with forwarding means for the goods, for example endless conveying belts.

It is furthermore possible to include a steaming process or a hot-dwell zone in the pretreatment or aftertreatment.

The operation method according to the present invention is further distinguished by the fact that the quantity of water required for the pretreatment and for the aftertreatment in rope form is smaller than that required for the treatment at full width.

The following examples illustrate the invention:

EXAMPLE 1

A polyester fiber-rayon staple fiber blended fabric 70:30 is dyed, whereby a greatly wool-like handle is attained.

For this purpose, the fabric in rope form is continuously washed with water in a continuous jet apparatus and, by passing it over a device as disclosed in German Offenlegungsschrift No. 25 37 665, it is forwarded to a treating unit, in which it is treated in rope form under tensionless conditions for 3 minutes at 120° C. Thereafter the fabric is rinsed with hot and with warm water of 60° C., subsequently, water is removed and the fabric is dried.

The fabric is thereafter dyed according to a single-bath-pad-thermosol process in the following manner:

It is padded at 20° C. with a liquor pick-up of 70% using an aqueous liquor which consists of 25 g/l of the disperse dye of the formula

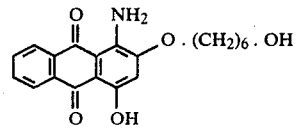

and 14.3 g/l of the reactive dye of the formula

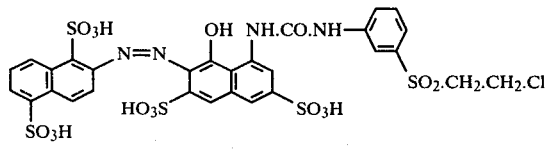

10 g/l of sodium bicarbonate 5 g/l of borax, it is dried at 120° C. and thermosoled for 60 seconds at 200° C.

For the aftertreatment, the fabric is gathered again to form a rope and is subsequently treated in the following manner:

It is rinsed at 40° C., soaped at 70° C. with 0.5 g/l of the condensation product of 1 mol of nonylphenol with 10 mols of ethylene oxide. Thereafter the fabric is treated with water, at a temperature of 95° C., in two baths, each time for a period of 5 minutes, while being passed through the treatment baths under little tension in U-shaped dwelling chambers. By repeatedly passing the fabric over a winch, a good displacement of the creases in made sure.

A red dyeing of the fabric is obtained. The fabric has a voluminous, pleasing handle.

When the fabric is died, after having been pretreated at full width, according to the same thermosol process and when it is submitted subsequently to an aftertreatment in a washing machine at full width, a flat, flabby handle is obtained.

EXAMPLE 2

A polyester fiber-rayon staple fiber blended fabric 70:30 is died, whereby a voluminous and wool-like handle is attained.

For this purpose, the fabric is pretreated analogously to Example 1, i.e. washed in rope form, treated in water for about 3 minutes at 110° C., the water is removed and the fabric is dried.

For dyeing the polyester portion according to the thermosol process, the fabric is padded with a liquor pick-up of 60% using an aqueous liquor of 40° C. which consists of 40 g/l of the disperse dye of the formula

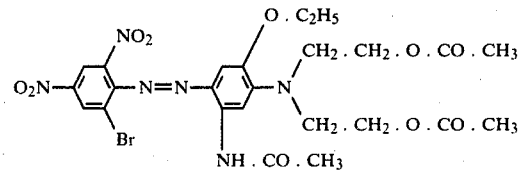

4 g/l of the red disperse dye of the formula

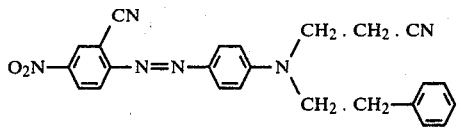

the fabric is dried and thermosoled for 60 seconds at 210° C.

Thereafter the rayon staple portion is cross-dyed according to the single bath-pad-steam process using 45 g/l of Sol. Sulphur Blue 10 C.I. No. 53 471

12 g/l of Sol. Sulphur Blue 7 C.I. No. 53 441

50 $cm^3$/l of sodium hydrogenosulfide solution of 25% strength and 5 g/l soda ash.

Padding is carried out with a liquor take-up of 60% at 30° C. and steaming is performed at 103° C. for 1 minute. Thereafter the fabric is oxidized with 2 g/l of sodium bichromate and 4 $cm^3$/l of acetic acid of 60% concentration at 80° C. and it is gathered to form a rope.

The further treatment is analogous to that of Example 1.

A navy-blue dyeing is obtained. The fabric has a voluminous, wool-like handle.

When the above described pretreatment and after-treatment in rope form are omitted, the fabric gets a flat, flabby handle.

EXAMPLE 3

A polyester fiber-rayon staple fiber blended fabric 70:30 is dyed, while a voluminous handle is attained.

For this purpose, the fabric is gathered to form a rope and is introduced into an aqueous treatment bath of 130° C. by passing it over a device as disclosed in German Offenlegungsschrift No. 25 37 665. The fabric is laid down loosely upon a conveying belt, while being penetrated by the hot aqueous liquor circulating by pumping. When the rope is transferred to a second conveying belt, its position changes so that an intense displacement of the creases takes place. This treatment lasts for 5 minutes. Thereafter the rope is opened, water is removed from the fabric by means of a suction device and subsequently the fabric is dried on a perforated drum drier.

Dyeing is carried out in two baths according to the thermosol-pad-steam process using disperse and reactive dyes.

For this purpose the fabric is padded with a liquor take-up of 60% at 40° C. with an aqueous liquor containing 35 g/l of the dye C.I. Disperse Blue 56, C.I. No. 63 285

13 g/l of the dye C.I. Disperse Orange 13, C.I. No. 26 080

10 g/l of the dye C.I. Reactive Yellow 17, C.I. No. 18 852 and 24 g/l of the reactive dye of the formula

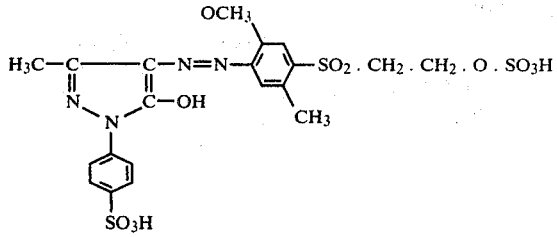

and 2 $cm^3$/l of acetic acid of 60% strength.

After padding, the fabric is dried at 120° C. and thermosoled for 60 seconds at 200° C.

Upon cooling, the fabric is over-padded at a temperature of about 20° C. likewise with a liquor take-up of 60% using 250 g/l of Glauber's salt and 20 $cm^3$/l of 32.5% sodium hydroxide solution and subsequently submitted to steaming for 30 seconds at 105° C. in a festoon ager.

Thereafter the fabric is rinsed, passed through a soaping bath of 60° C. which contains 3 g/l of the reaction product of 1 mol of nonylphenol and 10 mols of ethylene oxide and gathered to form a rope. In the further treatment in which the fabric is present in rope form, it is treated in water, first at 80° C. and thereafter at 100° C., each time for 2 minutes, thereafter the fabric is intensely squeezed off and rinsed with warm water of 60° C. and with cold water subsequently.

A bicolor dyeing is obtained, the polyester fibers being blue and the rayon staple fibers being yellow. the fabric has a voluminous handle.

EXAMPLE 4

A polyester fiber-rayon staple fiber blended fabric 70:30 is dyed to take a voluminous, wool-like handle.

For this purpose, the fabric is treated in rope form prior to dyeing. It is washed at 60° C. with an aqueous liquor which contains 0.5 g/l of the reaction product of 1 mol of nonylphenol with 10 mols of ethylene oxide, it is treated for 5 minutes in water of 30° C. while being guided completely tensionless (cf. Example 3). After rinsing, water is removed by means of high-efficiency squeeze rollers and the fabric is dried.

Dyeing is carried out according to the two-bath-thermosol-pad-steam process using disperse and vat dyes. For this purpose, the fabric is padded with a liquor take-up of 60% with an aqueous liquor of 60° C. which contains 35 g/l of the dye C.I. Disperse Blue 56 C.I. No. 63 285, 1.5 g/l of the dye C.I. Disperse Orange 13 C.I. No. 26 080.

The fabric is dried and thermosoled for 60 seconds at 200° C.

The rayon staple fiber portion is dyed by over-padding with an aqueous liquor of 20° C. which contains 13 g/l of Vat Orange 1, C.I. No. 59 105, 50 $cm^3$/l of sodium hydroxide solution of 32.5% strength and 42 g/l of sodium dithionite with a liquor take-up of 60%. The trough of the padding machine should be as small as possible.

Immediately after padding, the fabric is steamed for 30 seconds, at 105° C., then it is rinsed continuously, oxidized with 2 $cm^3$/l of hydrogen peroxide and slightly acidified with 5 $cm^3/l$ of acetic acid of 60% strength.

Thereafter the fabric is gathered by guide rings to form a rope and is thereafter further treated analogously to the preceding example.

A bicolor dyeing is obtained. The fabric has a voluminous, wool-like handle.

When the combined pretreatment and aftertreatment in rope form are omitted, the fabric takes a flat and flabby handle after dyeing.

What is claimed is:

1. A process for dyeing and printing flat textile articles containing synthetic fibers endowing an optimum handle to the goods comprising the steps of (a) pretreating said textile in rope form with at least one pretreatment bath at 80°-140° C. followed by drying;

(b) impregnating said textile at full width with a dye in an aqueous medium;

(c) fixing the dyestuff;

(d) aftertreating the dyed textile again in rope form under as little tension as possible in at least two aftertreatment baths at least one of which having a temperature of 80°-140° C.; and (e) advancing the thus treated textile through a dwelling chamber while changing the position of the folds in the textile rope.

2. Process as claimed in claim 1, which comprises carrying out the pretreatment and the aftertreatment in rope form continuously.

3. Process as claimed in claim 1, which comprises carrying out continuously the pretreatment, the dyeing and the aftertreatment.

4. Process as claimed in claim 1, which comprises carrying out the pretreatment at least in one bath in the alkaline range at a temperature of from 80° to 140° C.

5. Process as claimed in claim 1, which comprises carrying out the aftertreatment in at least one bath at a temperature of from 80° to 140° C. using nonionic, and/or anionic auxiliaries in the presence of alkalies and of a reduction agent.

6. Process as claimed in claim 1, which comprises achieving a high liquor circulation in the pretreatment and in the aftertreatment by means of a circulation pump.

7. Process as claimed in claim 1, which comprises dyeing or printing textile material made of polyester fibers or filaments with disperse dyes, textile material made of polyester fibers and rayon staple fibers with disperse dyes and vat dyes, with disperse dyes and reactive dyes or with disperse dyes and sulfur dyes or textile material made of polyester fibers and wool with disperse dyes and acid dyes, with reactive dyes or metallic complex dyes.

8. Process as claimed in claim 1, which comprises dyeing or printing textile material made of modified polyester fibers alone or in admixture with cellulose fibers or wool.

9. Process as claimed in claim 1, which comprises dyeing or printing textile material made of polyamide fibers with acid dyes, reactive dyes or metallic complex dyes or textile material made of polyacrylonitrile fibers with cationic dyes.

* * * * *